US011937722B2

(12) United States Patent
Walsh et al.

(10) Patent No.: US 11,937,722 B2
(45) Date of Patent: Mar. 26, 2024

(54) TROPHY DEVICE AND METHOD OF MAKING THE SAME

(71) Applicants: Matthew Walsh, Orange, CA (US); Dax Holt, Anaheim, CA (US); Eugene Yesin, Laguna Hills, CA (US)

(72) Inventors: Matthew Walsh, Orange, CA (US); Dax Holt, Anaheim, CA (US); Eugene Yesin, Laguna Hills, CA (US)

(73) Assignee: TrophySmack, Inc., Orange, CA (US)

( * ) Notice: Subject to any disclaimer, the term of this patent is extended or adjusted under 35 U.S.C. 154(b) by 718 days.

(21) Appl. No.: 16/986,096

(22) Filed: Aug. 5, 2020

(65) Prior Publication Data

US 2021/0282582 A1 Sep. 16, 2021

Related U.S. Application Data

(60) Provisional application No. 62/988,837, filed on Mar. 12, 2020.

(51) Int. Cl.
*A47G 33/00* (2006.01)

(52) U.S. Cl.
CPC ..... *A47G 33/004* (2013.01)

(58) Field of Classification Search
CPC ..... A47G 33/004
USPC ..... 428/542.4
See application file for complete search history.

(56) References Cited

U.S. PATENT DOCUMENTS

| | | | | |
|---|---|---|---|---|
| 4,202,241 | A * | 5/1980 | Lucas | G10D 13/12 984/150 |
| 5,365,683 | A * | 11/1994 | Borja | A47G 1/14 40/781 |
| 10,442,140 | B2 | 10/2019 | Surber | |
| 2002/0053154 | A1* | 5/2002 | Stephan | A47G 1/06 40/765 |
| 2003/0082316 | A1* | 5/2003 | Scott | B44C 5/02 428/16 |
| 2016/0242405 | A1* | 8/2016 | Zhang | A01N 65/22 |

OTHER PUBLICATIONS

Trophy Smack, "Fantasy Football Greatness", 2017, p. 1-2; Accessed at https://web.archive.org/web/20180104095543/https://www.trophysmack.com/.*

Marco Awards Group Master Catalog, 2009, p. 1-391; Accessed at http://www.carolinatrophies.com/PDF/DTC%202009%20Master%20Catalog.pdf.*

* cited by examiner

*Primary Examiner* — Mark Ruthkosky
*Assistant Examiner* — Julia L Rummel
(74) *Attorney, Agent, or Firm* — The Myers Law Group; Justin G. Sanders

(57) ABSTRACT

A trophy apparatus, comprising a plurality of columns; a base piece comprising a plurality of grooves, each configured to attach to a bottom end of each of the plurality of columns, and further comprising an interface configured to couple to a plaque mount; and a lid piece comprising a plurality of grooves, each configured to attach to a top end of each of the plurality of columns.

13 Claims, 15 Drawing Sheets

TROPHY DEVICE AND METHOD OF MAKING THE SAME

PRIORITY CLAIM

This application claims the priority date of provisional application No. 62/988,837 filed on Mar. 12, 2020, which is herein incorporated by reference in its entirety.

BACKGROUND

The present disclosure relates generally to a novel trophy device and method of making the same.

The current state of the art for trophies involve parts such as rods, plastic columns, and couplers, which when assembling the same requires one to assemble it in an upside-down fashion. Such assembly also requires a balancing act to fit the parts together, including the lid of the columns, the rods, nuts, and/or base of the trophy, typically by hand or manual assembly. For larger sized trophies, parts such as couplers must be used in order to connect two or more rods together so as to extend the rods' length for attachment to the lid and base of the trophy.

Further, such assembly requires one to align the columns of the trophy by 'free hand' or 'eyeballing,' which creates difficulty in ensuring that each column is straight in addition to being adequately secured by tightening of the nuts. Since such trophies' columns are typically held in place solely by the tightness of the nuts, the columns can easily shift around, including during handling and shipping of the trophies to customers. Typically, plaques are attached to the trophy using mounting tape or screws which make it cumbersome or ineffective to change a plaque.

The proposed device and method for a trophy device and method of making the same allows for substantial efficiency in assembly of the trophy as well as significant durability and stability of the assembled trophy, including during shipment of the trophy to customers. Furthermore, the present invention allows for interchangeability of the trophy's plaque piece via a unique track system.

SUMMARY

A trophy apparatus, comprising a plurality of columns; a base piece comprising a plurality of grooves, each configured to attach to a bottom end of each of the plurality of columns, and further comprising an interface configured to couple to a plaque mount; and a lid piece comprising a plurality of grooves, each configured to attach to a top end of each of the plurality of columns.

A trophy apparatus, comprising a plurality of cylindrical columns; a base piece having a plurality of grooves on a top side, each configured to attach to a bottom end of each of the plurality of columns; a lid piece having a plurality of grooves on a bottom side, each configured to attach to a top end of each of the plurality of columns; a plaque mount configured to removably attach to the base piece; and a plaque piece comprising a plurality of inner tracks on a rear side that are configured to slidably attach with a plurality of U-shaped prongs situated on a forward-facing side of the plaque mount.

A method of making a trophy apparatus, comprising the steps of forming a plurality of cylindrical columns; forming a base piece having a plurality of grooves on a top side, each configured to attach to a bottom end of each of the plurality of columns; forming a lid piece having a plurality of grooves on a bottom side, each configured to attach to a top end of each of the plurality of columns; forming a plaque mount configured to removably attach to the base piece and that comprises a plurality of U-shaped prongs situated on a forward-facing side of the plaque mount; and forming a plaque piece comprising a plurality of inner tracks on a rear side that are configured to slidably attach with the U-shaped prongs of the plaque mount.

LISTING OF REFERENCE NUMERALS OF AN EXEMPLARY EMBODIMENT

Figure 1:
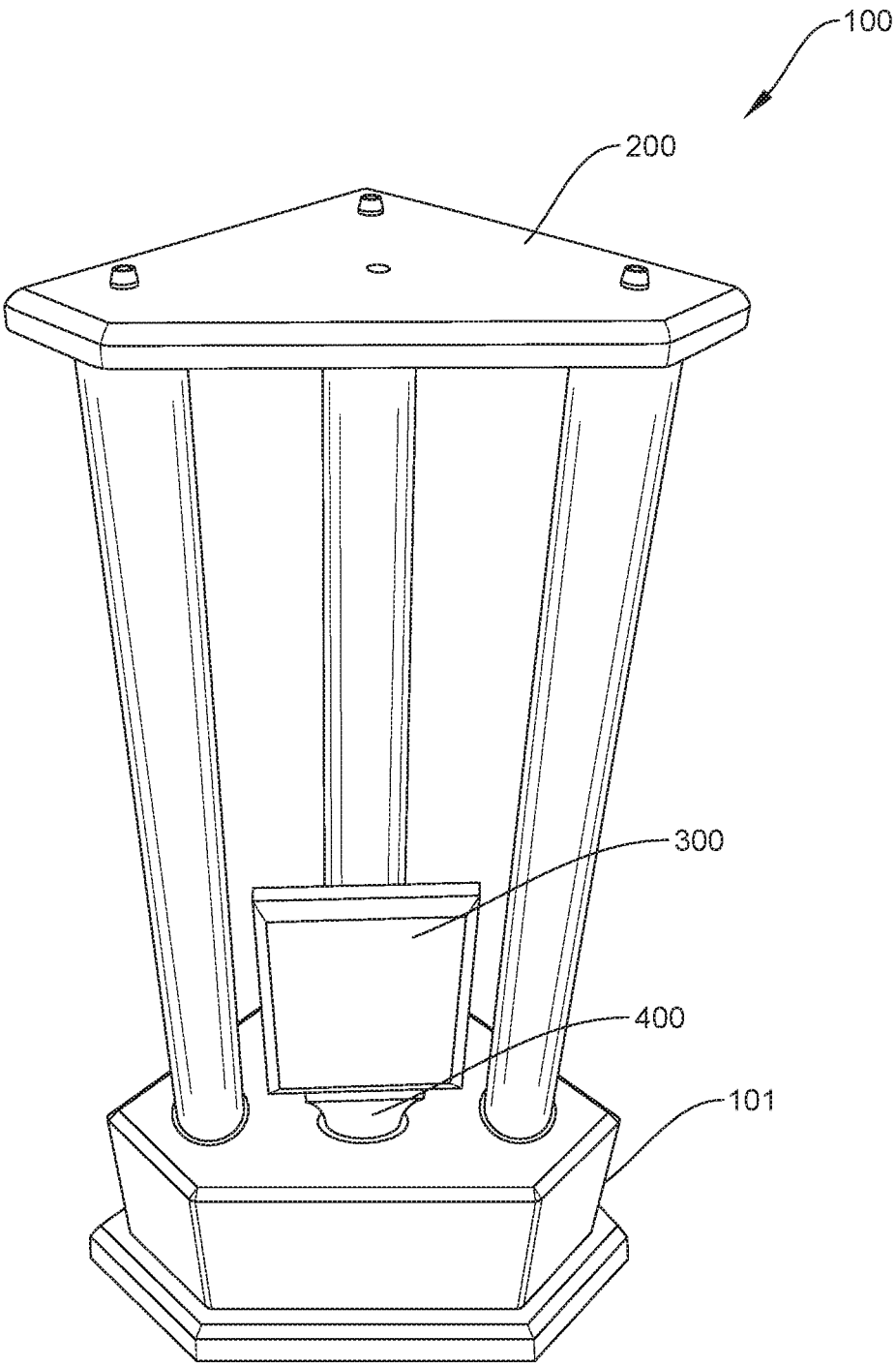
FIG. 1 illustrates a perspective view of a trophy device in accordance with one embodiment.

Trophy device 100
Base 101
Base rim 101*a*
Base column grooves 102
Base insertion points/interfaces 102*a*
Plaque mount insertion point/interface 103
Plaque mount groove 104
Plaque mount insertion end point/interface 105
Columns 50
Column caps 51
Cap outer rim 51*a*
Cap inner threaded rim 51*b*
Bolt insertion point/interface 51*c*
Column threaded bolts 52
Column threaded rim 53
Conical bolts 54
Trophy lid piece 200
Lid column grooves 201
Lid insertion points/interfaces 201*a*
Plaque 300
Tracks 301
Plaque mount 400
Prongs 401
Plaque mount base 402
Plaque mount panel 403
Plaque mount shelf 404

Plaque mount insertion point/interface 405
Plaque mount pin 406
Topper insertion point/interface 407

DESCRIPTION OF THE PREFERRED EMBODIMENTS

The detailed descriptions set forth below in connection with the appended drawings are intended as a description of embodiments of the invention and are not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

FIG. 1 illustrates a perspective view of a trophy device 100 in accordance with one embodiment. Trophy device 100 may comprise a base 101, one or more columns a lid piece 200, a plaque 300, and a plaque mount 400. Trophy device 100 may be outfitted with one of more plaques 300 and plaque mounts 400 depending on customization requirements.

Figure 2A:
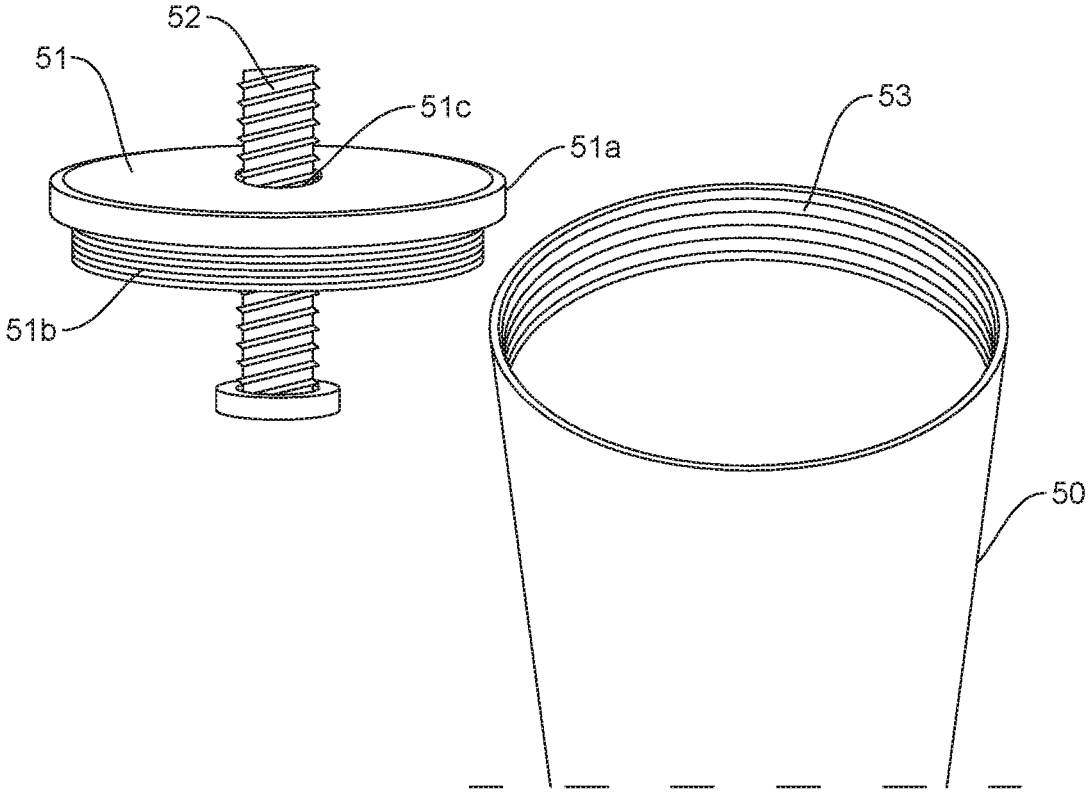
FIG. 2A illustrates a column cap with a bolt component and a bottom portion of a column.
Figure 2B:
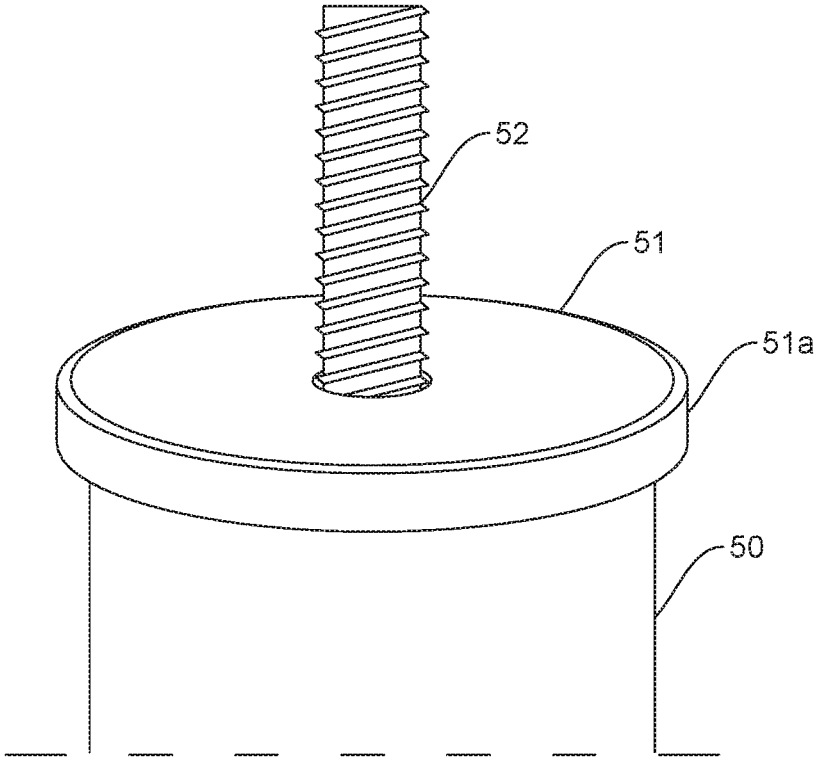
FIG. 2B illustrates the column cap with the bolt component coupled to the base of a column.

FIG. 2A illustrates a column cap 51 and cap bolt 52 component that is configured to fit on a bottom end of column 50 that is configured to attach to base 101. FIG. 2B illustrates column cap 51 and cap bolt 52 component (shown coupled to a column groove 102 in FIG. 4A below) prefabricated on a top surface of base 101. Column cap 51 further comprises outer rim 51*a*, inner threaded rim 51*b*, and a bolt insertion point/interface 51*c*. Such outer rim 51*a* of column cap 51 may serve to reinforce the positioning and stability of column 50 when installed onto base 101. Bolt insertion point/interface 51*c* may be comprised of an opening in a center portion of cap 51 and which is threaded in configuration in order to allow for the coupling of bolt 52 therethrough. Each end of column 50 has an inner threaded rim 53 to allow for coupling to column cap 51 via the inner threaded rim 51*b* of column cap 51. FIG. 2B depicts how bolt 52 may be completely threaded through insertion point/interface 51*c* prior to coupling column cap 51 to column 50. In such case, bolt 52 is in a configuration so that column 50 can be attached to base 101. In the exemplary embodiment of trophy 100, columns 50 and column caps 51 are composed of a metal material, such as an anodized metal material. Use of a metal material allows for increased durability of trophy 100 and significantly decreases the likelihood of trophy 100 becoming disjointed, damaged, cracked, or offset during shipping and handling. Such durability of the metal materials also allows for trophy 100 to be shipped to a customer in a fully assembled form.

Figure 3A:
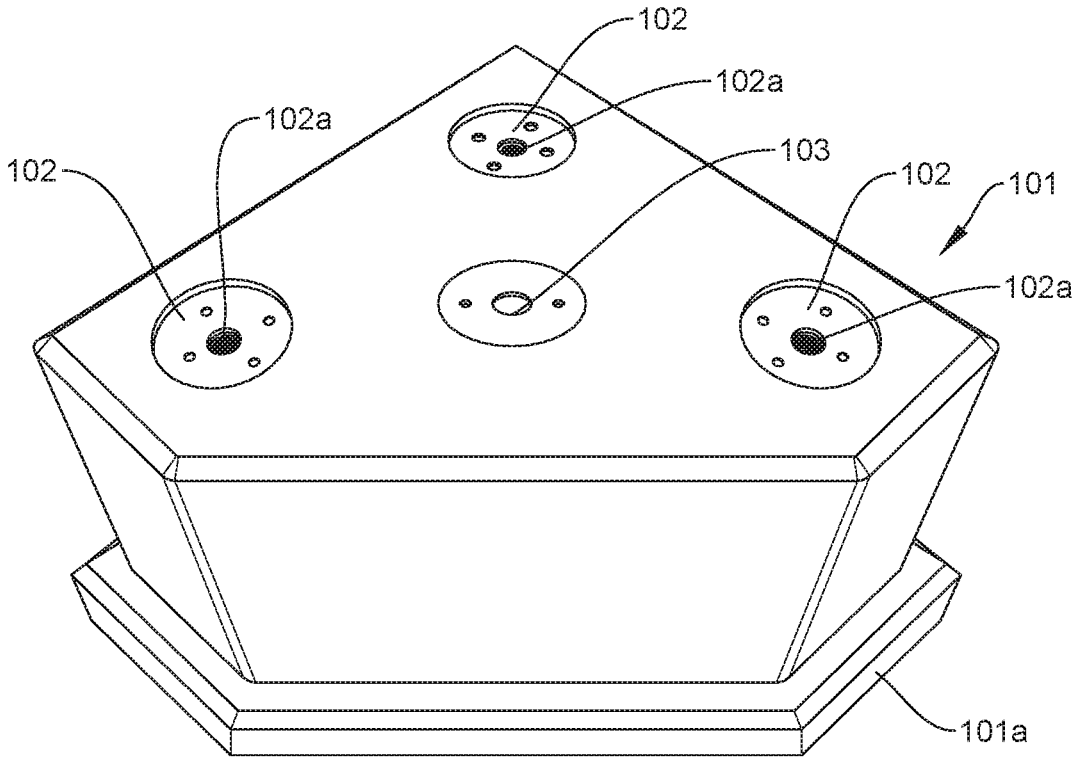
FIG. 3A illustrates a base component of the trophy device.

FIG. 3A illustrates base 101 of the trophy device 100 without any column 50 or plaque 300 attachments. Base 101 may further comprise a base rim 101*a*, one or more column grooves 102, one or more insertion points/interfaces 102*a*, and a plaque mount insertion point/interface 103. Base 101 may be comprised of a wooden material and have a triangular shape in the exemplary embodiment. Base 101 may have a height of 5 to 7 inches in the exemplary embodiment so as to allow spacing for award or competition engraving pieces to be attached around the sides of base 101 as desired.

Column grooves 102 may be circular in shape, disc-shaped, and/or cylindrical shaped, as well as have a height that is equal or substantially equal to the height of column cap 51 in order to further secure column 50 within column groove 102. As referred to earlier with respect to FIG. 2B, bolt 52 is threaded within column cap 51 which may then be secured to base 101 by screwing it into insertion point/interface 102*a* (See FIG. 4A for further detail and depiction).

Figure 3B:
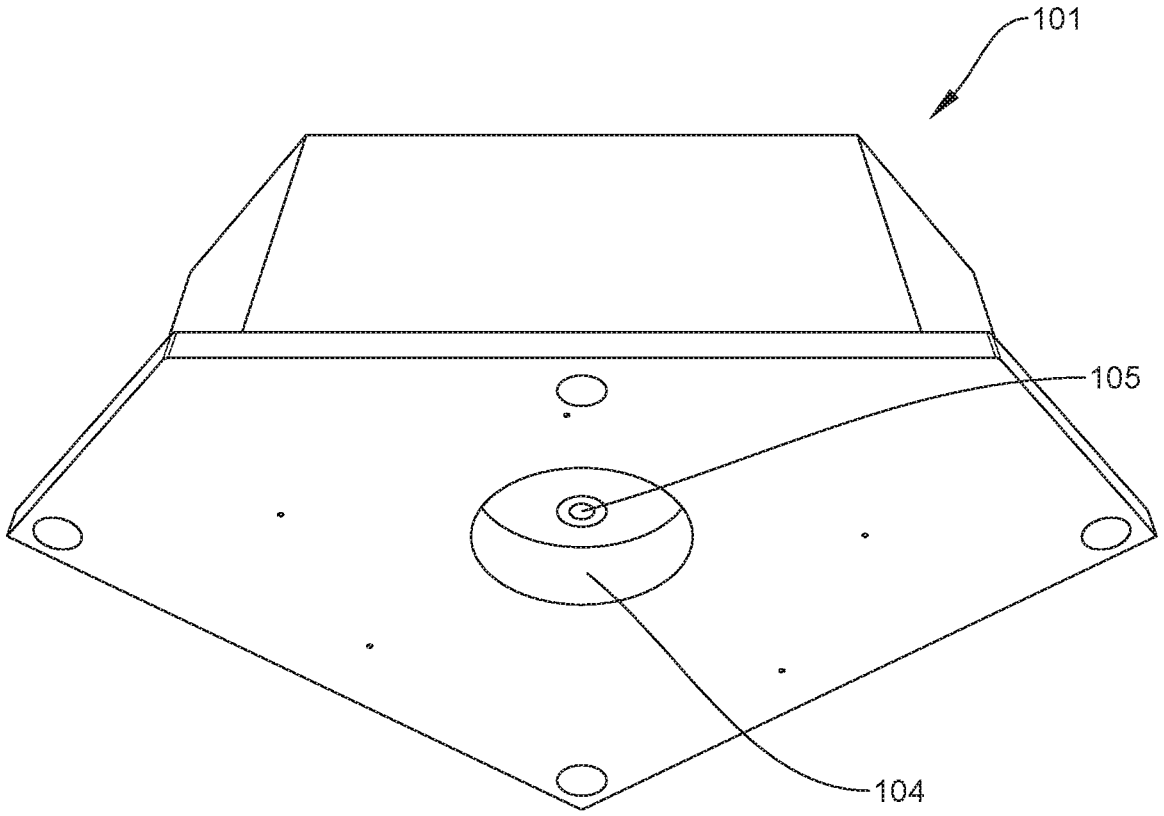
FIG. 3B illustrates the bottom perspective view of the base of the trophy device.

The top surface of base 101 may be at least two inches in thickness so as to allow for the prefabrication of one or more column grooves 102 and for the secure attachment of one or more bolts 52 that are screwed (including vertically) into one or more insertion points/interfaces 102*a*. FIG. 3B illustrates a bottom perspective view of base 101 of trophy device 100. The bottom portion of base 101 may comprise a groove 104 which is circular in shape, and which may further comprise an insertion end point/interface 105 positioned in a center area of the circular shape of groove 104. Insertion end point/interface 105 may be utilized to further guide and secure plaque mount pin 403 in place (further discussed below).

Figure 4A:
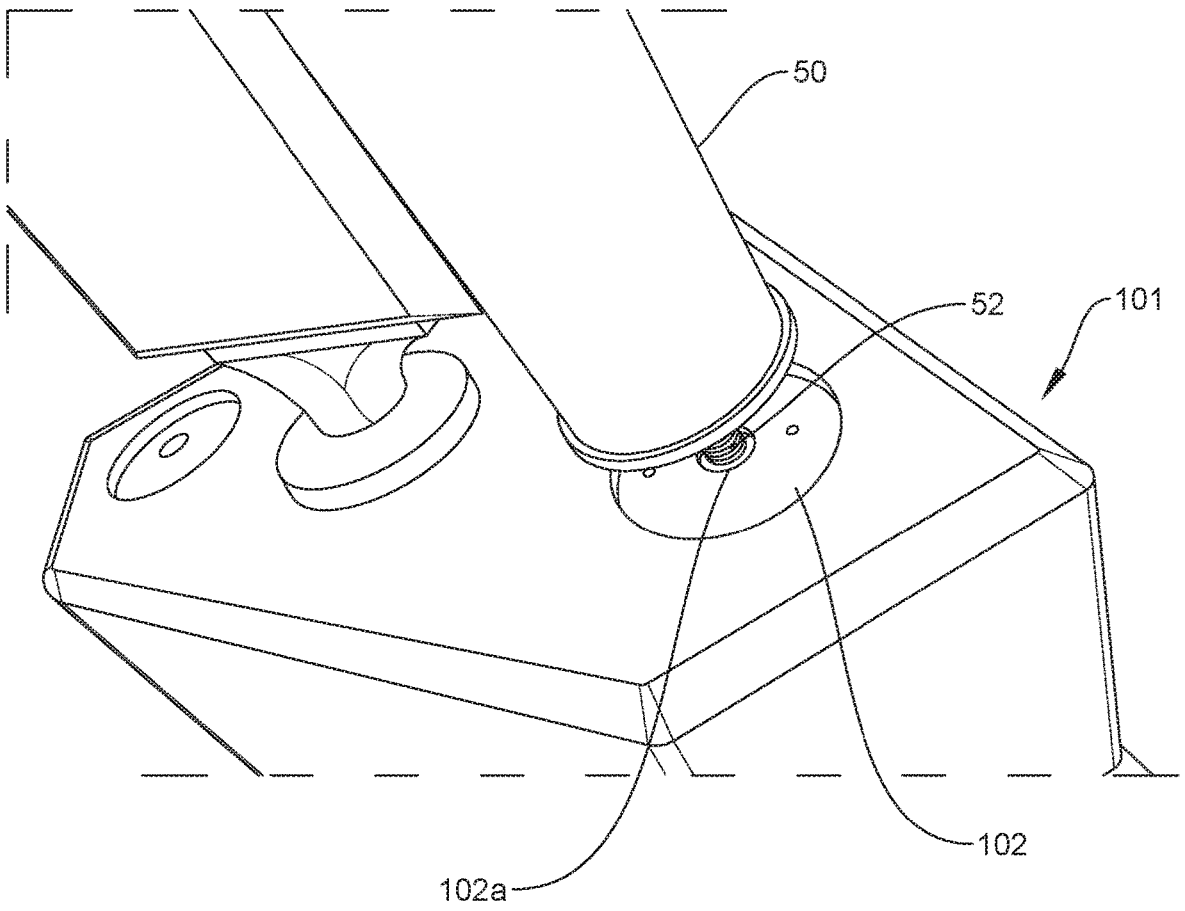
FIG. 4A illustrates a column component being coupled to the base piece of the trophy device.
Figure 4B:
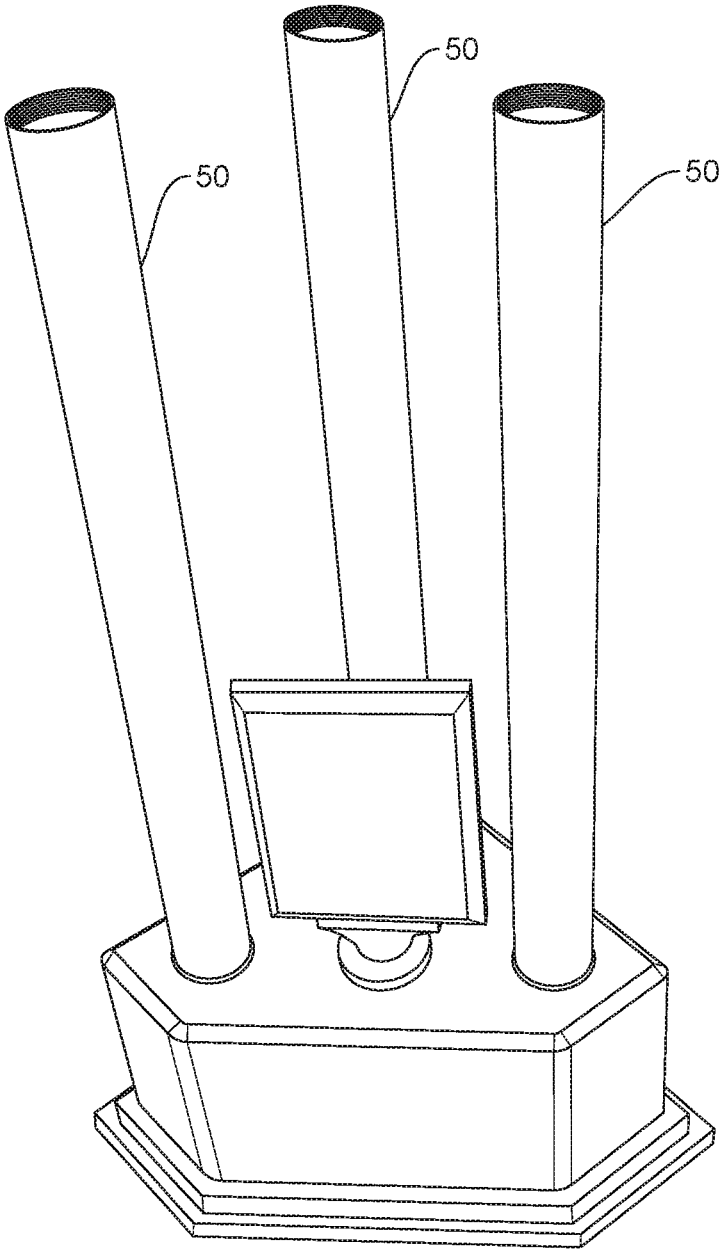
FIG. 4B illustrates a configuration of three columns coupled to the base piece of trophy device.

FIG. 4A illustrates column 50 being attached to base 101 via bolt 52, which is already secured to column 50 via column cap 51. As base 101 may comprise one or more grooves 102 for placement of one or more columns 50, FIG. 4B illustrates a configuration where three columns 50 are coupled in a triangular configuration to base 101.

Figure 5A:
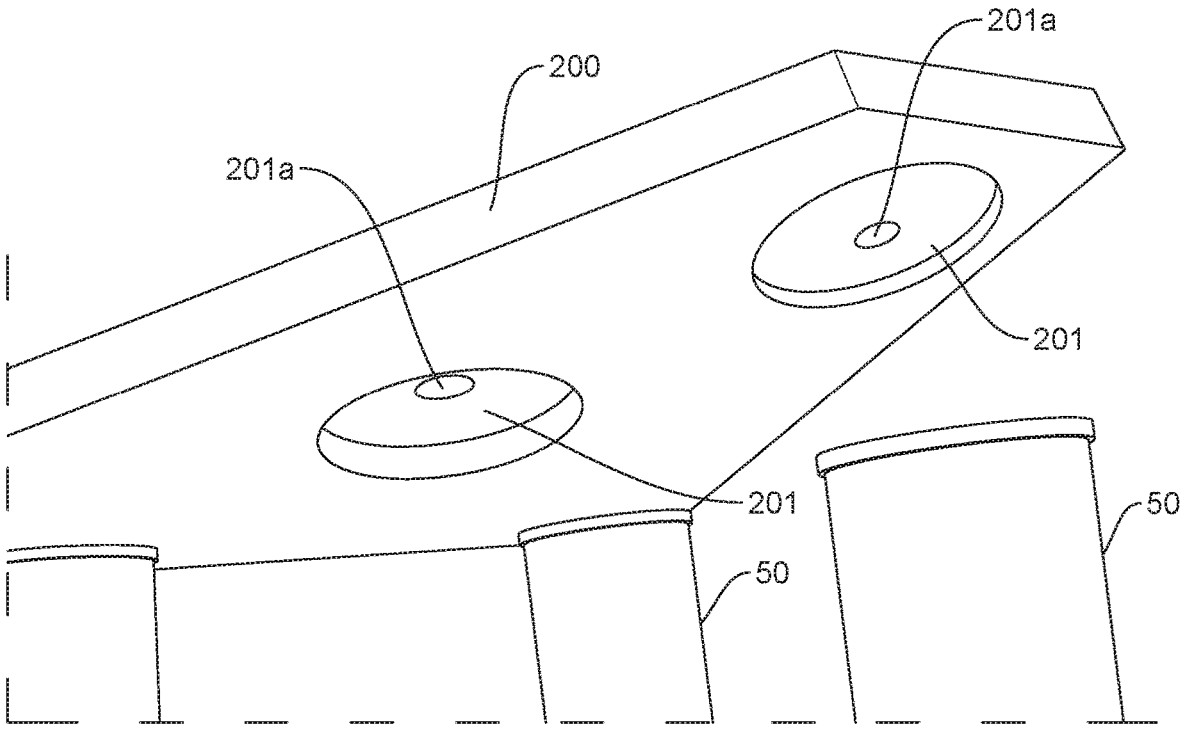
FIGS. 5A-C illustrate a trophy lid piece being coupled to top ends of the three column pieces and fastened with a plurality of bolt devices.
Figure 5B:
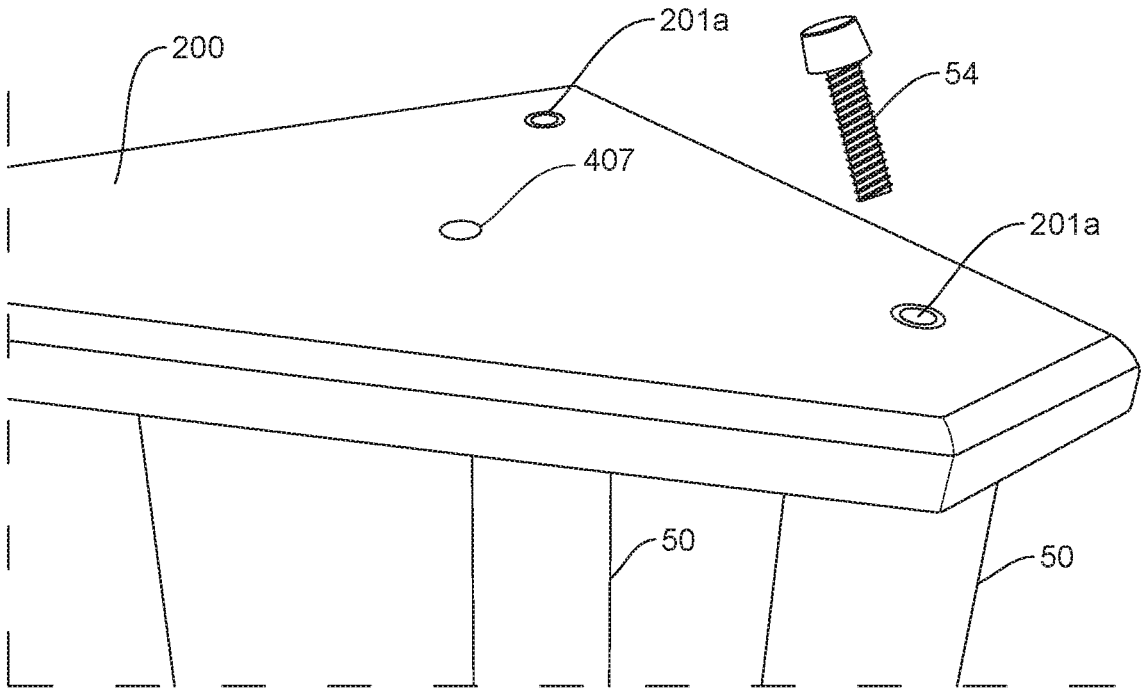
Figure 5C:
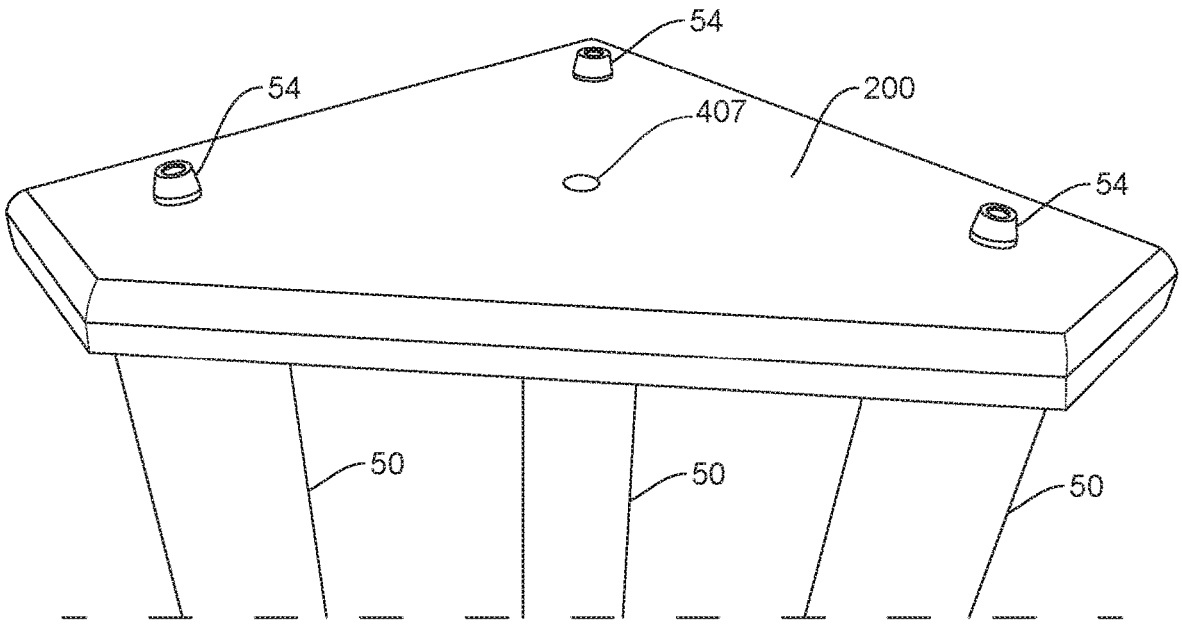

FIGS. 5A-C illustrate a trophy lid piece 200 being coupled to a plurality of top ends of columns 50 and further fastened to lid 200 via a plurality of conical bolts 54. Lid 200 may comprise one or more lid column grooves 201 that are circular in shape and configured to hold column cap 51 that is attached to a top end of column 50. In this configuration, lid column grooves 201 are prefabricated onto a bottom side of lid 200. Once each column cap 51 has been inserted into each lid column groove 201, conical bolts 54 are screwed into lid insertion points/interfaces 201*a* in order to further secure column cap 51 and column 50 to lid 200. Conical bolts 54 may comprise conical Allen bolts, although other similar bolts or fastening devices, such as other screws, pegs, or snaps may be utilized to further secure column caps 51 and column 50 to lid 200. Trophy lid 200 may also comprise a topper insertion point/interface 407 so that a topper (not shown), such as an ornamental football, soccer ball, or basketball, may be installed thereon as desired. Topper (not shown) may comprise a hexagonal female threaded insert at a center of its bottom portion to allow for a corresponding hexagonal shaped bolt (such as a 1 inch bolt) to be threaded through from below trophy lid 200 through topper insertion point/interface 407 and inserted into topper.

Figure 6A:
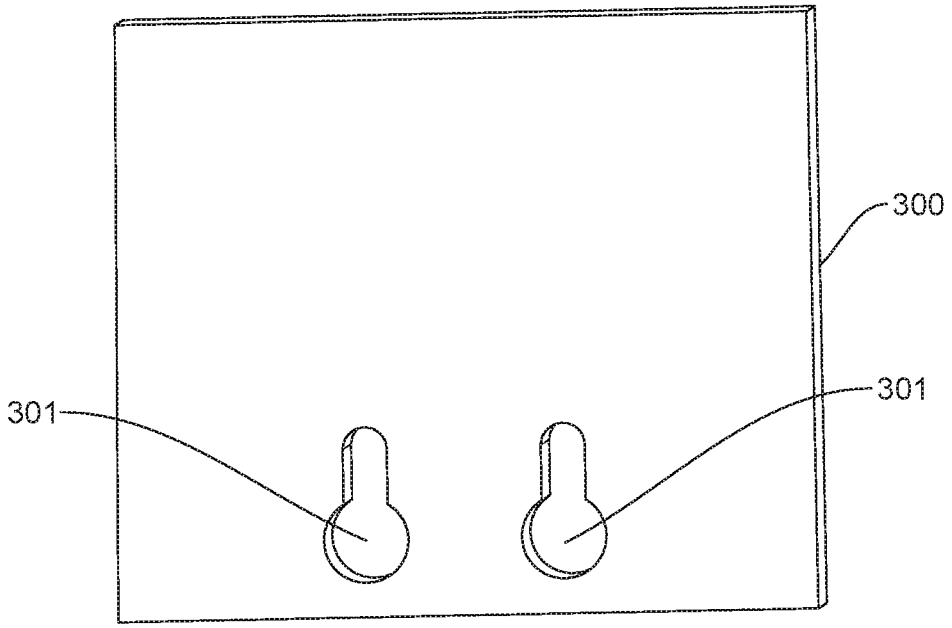
FIGS. 6A-B illustrate a plaque piece and plaque mount piece.
Figure 6B:
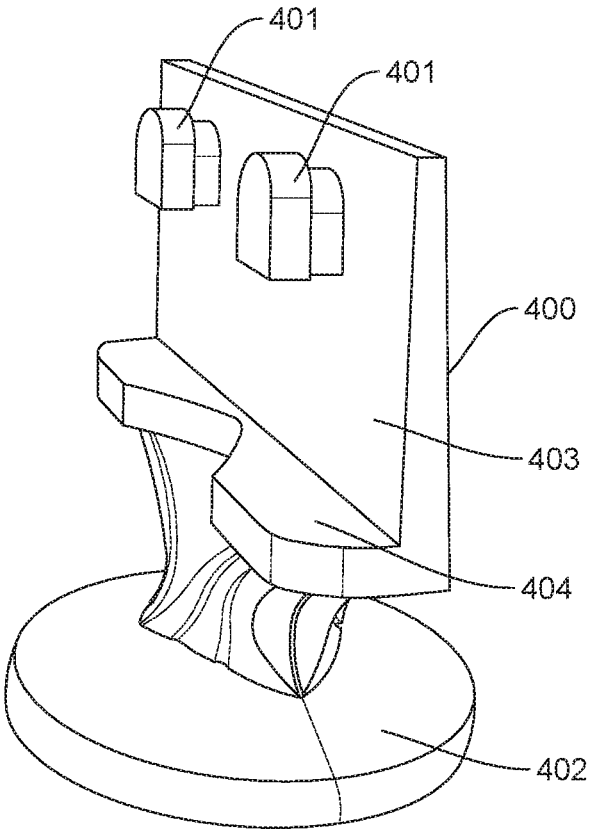

FIGS. 6A-B illustrate plaque 300 and plaque mount 400 that may be coupled together prior to attachment to base 101. Plaque 300 may comprise one or more inner tracks 301 that are inset therewithin and configured to receive and attach to one or more prongs 401 of plaque mount 400. One or more inner tracks 301 are prefabricated within a rear side of plaque 300, with their outer surface which may comprise a thermometer-like shape, or an inverted U-shape atop a circular or bulb shape and their inner surface within plaque 300 which may comprise rounded edges configured to receive and fit snugly around prongs 401. Prongs 401 may be positioned in a horizontally raised position off of an upper front facing side of plaque mount panel 403. Prongs 401 may be shaped as inverted three-dimensional U-shapes, positioned along a single horizontal axis, and spaced apart so that they are aligned to be able to be inserted evenly into tracks 301. However, prongs 401 may be formed from alternate shapes and dimensions without deviating from the scope of the present invention.

Figure 6C:
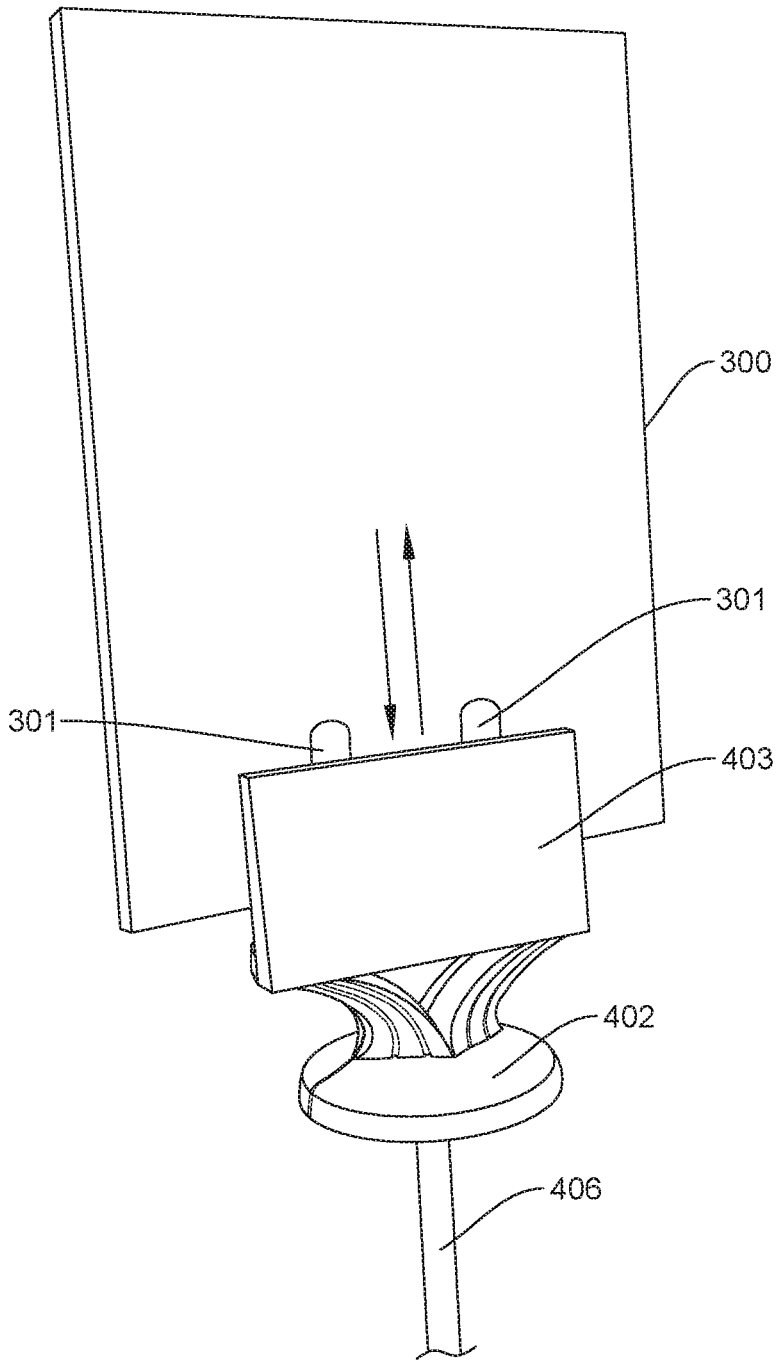
FIG. 6C illustrates the plaque and plaque mount pieces being coupled together.
Figure 6D:
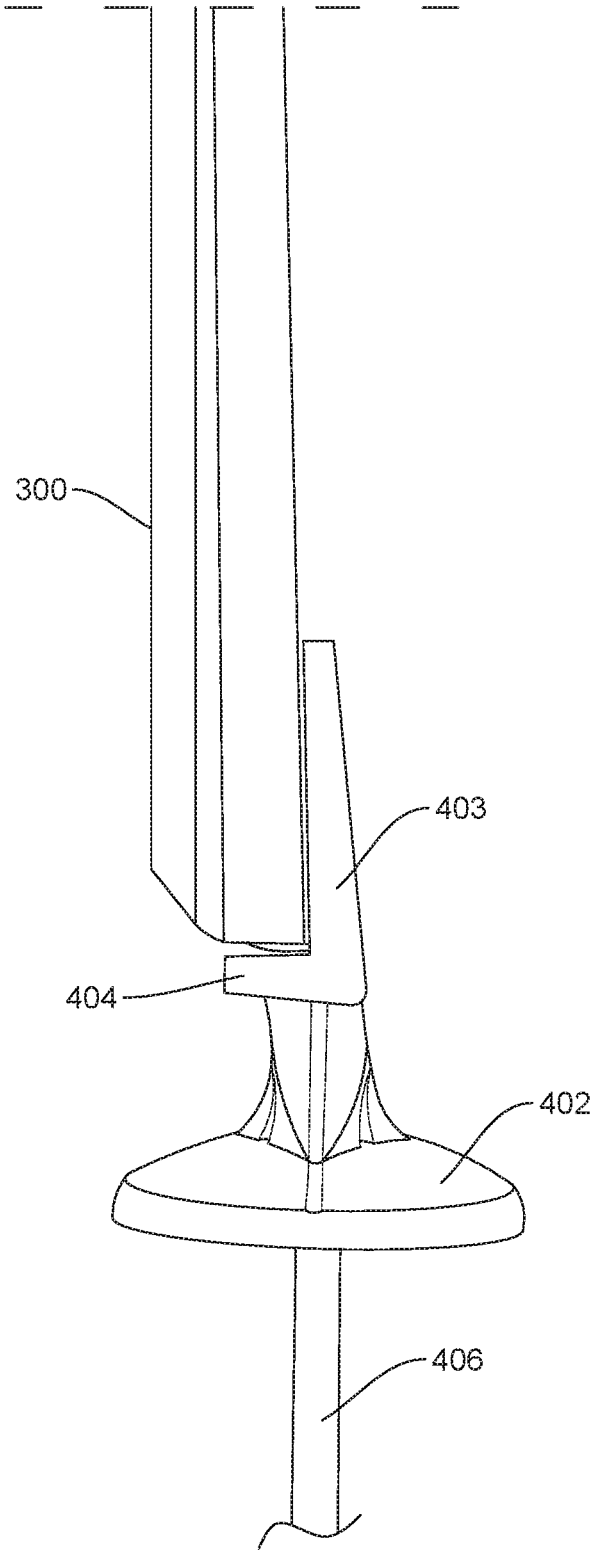
FIG. 6D illustrates a side view of the plaque and plaque mount pieces coupled together.

FIG. 6C illustrates plaque 300 and plaque mount 400 being coupled together by inserting prongs 401 into the circular or bulb portion of tracks 301 and sliding prongs 401 in an upward fashion. FIG. 6D illustrates a side view of plaque 300 and plaque mount 400 attached together. Tracks 301 are slid down upon prongs 401 which are already inserted therein, until a bottom side of plaque 300 is substantially flush with plaque mount shelf 404.

Figure 7A:
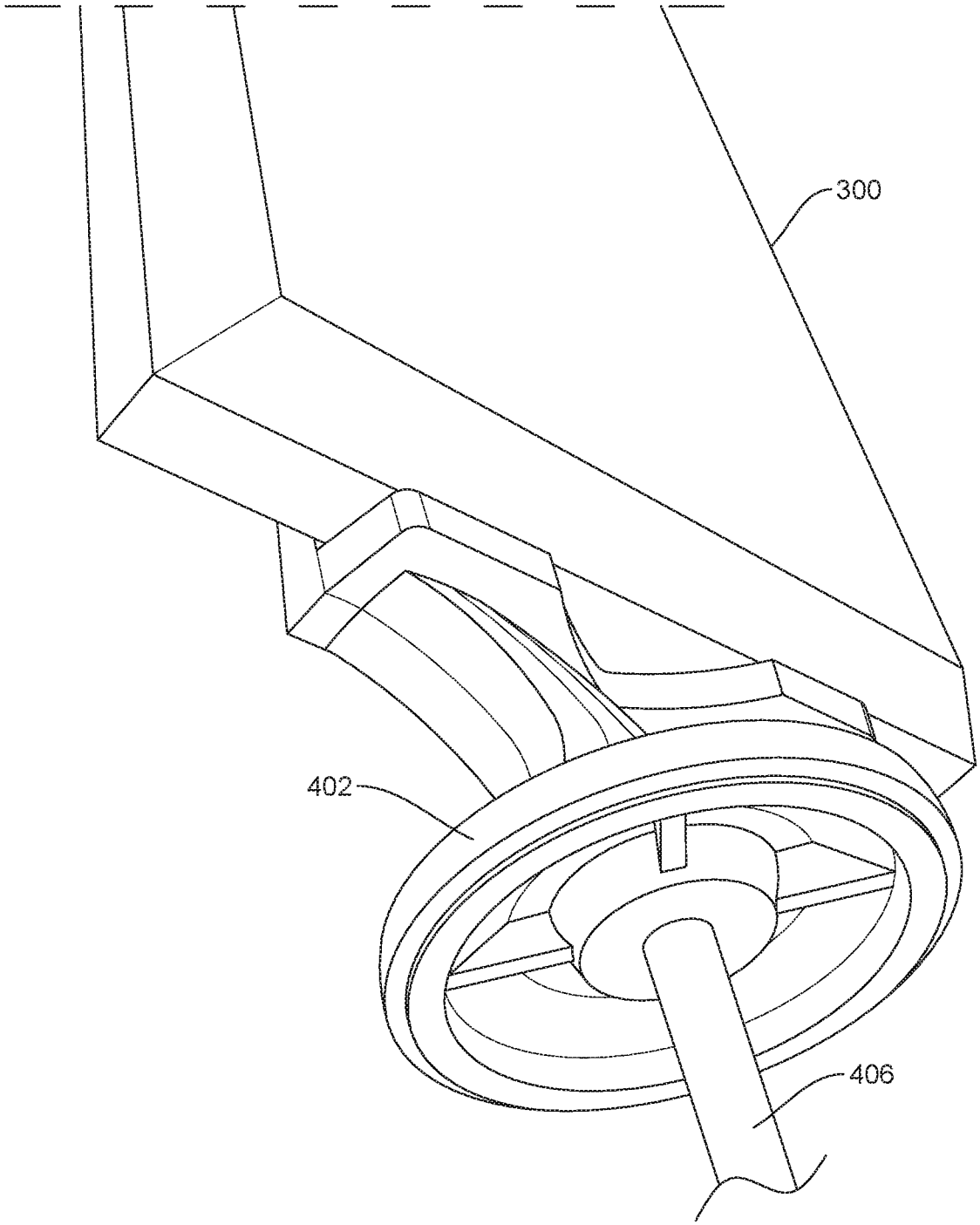
FIG. 7A illustrates a bottom view of the plaque mount piece.
Figure 7B:
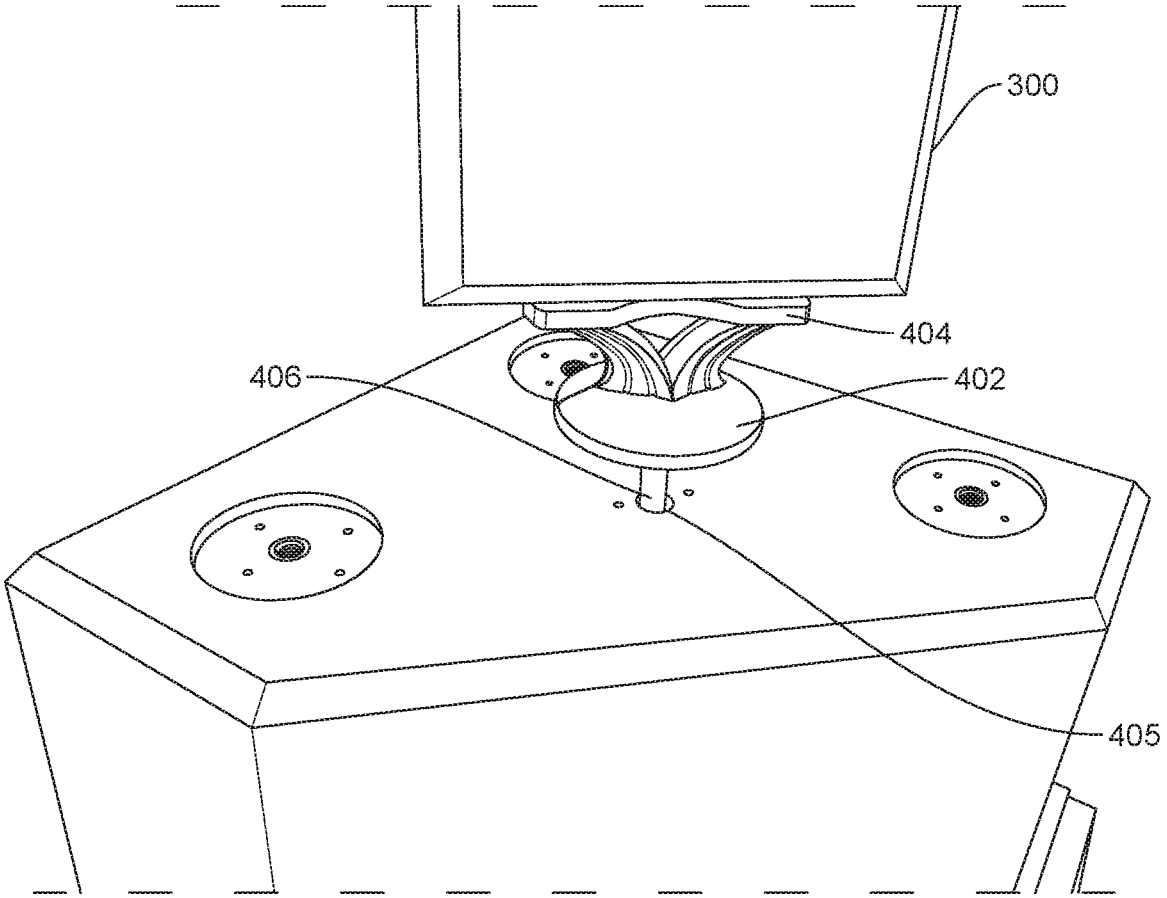
FIG. 7B illustrates the plaque and plaque mount pieces being coupled to the trophy base.

FIG. 7A illustrates a bottom view of plaque mount base 402, which comprises plaque mount insertion point/interface 405. Insertion point/interface 405 and insertion end point/interface 105 may be configured to receive a plaque mount pin 406 through the body of base 101. FIG. 7B illustrates how plaque mount 400 is attached to base 101 via plaque mount pin 406.

Various aspects of the present invention are described herein with reference to illustrations and/or diagrams according to embodiments of the invention. While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. A trophy apparatus, comprising:

a plurality of columns;

a bottom end of each column providing a bottom column cap threadably engaged therewith, an outer surface of each of the bottom column caps providing a threaded rim configured for threadable engagement with a corresponding threaded rim of an inner surface of the bottom end of a corresponding one of the columns;

each bottom column cap providing a threaded opening through which a bottom cap bolt threadably extends;

an opposing top end of each column providing a top column cap threadably engaged therewith, an outer surface of each of the top column caps providing a threaded rim configured for threadable engagement with a corresponding threaded rim of an inner surface of the top end of a corresponding one of the columns;

each top column cap providing a threaded opening through which a top cap bolt threadably extends;

a base piece providing a plurality of base column grooves positioned on a top surface thereof, each of the base column grooves sized and configured for receiving the bottom column cap of a corresponding one of the columns therewithin;

each of the base column grooves providing a threaded interface positioned and configured for threadably receiving the bottom cap bolt of a corresponding one of the columns when the bottom column cap of said corresponding one of the columns is inserted into said base column groove;

a lid piece providing a plurality of lid column grooves positioned on a bottom surface thereof, each of the lid column grooves sized and configured for receiving the top column cap of a corresponding one of the columns therewithin; and each of the lid column grooves providing a threaded interface positioned and configured for threadably receiving the top cap bolt of a corresponding one of the columns when the top column cap of said corresponding one of the columns is inserted into said lid column groove.

2. The trophy apparatus of claim 1, wherein:

each of the bottom column caps and top column caps is circular in cross-section and cylindrical in shape; and each of the base column grooves and lid column grooves is circular in cross-section and cylindrical in shape.

3. A trophy apparatus, comprising:

a plurality of columns;

a bottom end of each column providing a bottom column cap threadably engaged therewith, an outer surface of each of the bottom column caps providing a threaded rim configured for threadable engagement with a corresponding threaded rim of an inner surface of the bottom end of a corresponding one of the columns;

each bottom column cap providing a threaded opening through which a bottom cap bolt threadably extends;

an opposing top end of each column providing a top column cap threadably engaged therewith, an outer surface of each of the top column caps providing a threaded rim configured for threadable engagement with a corresponding threaded rim of an inner surface of the top end of a corresponding one of the columns;

each top column cap providing a threaded opening through which a top cap bolt threadably extends;

a base piece providing a plurality of base column grooves positioned on a top surface thereof, each of the base column grooves sized and configured for receiving the bottom column cap of a corresponding one of the columns therewithin;

each of the base column grooves providing a threaded interface positioned and configured for threadably receiving the bottom cap bolt of a corresponding one of the columns when the bottom column cap of said corresponding one of the columns is inserted into said base column groove;

a lid piece providing a plurality of lid column grooves positioned on a bottom surface thereof, each of the lid column grooves sized and configured for receiving the top column cap of a corresponding one of the columns therewithin;

a plaque mount engageable with the top surface of the base piece, a front surface of the plaque mount providing a plurality of U-shaped prongs positioned in a substantially parallel, spaced apart arrangement; and a plaque piece providing a plurality of inner tracks positioned in a substantially parallel, spaced apart arrangement on a rear surface thereof, the inner tracks configured for slidably receiving the U-shaped prongs of the plaque mount, thereby engaging the plaque piece with the plaque mount.

4. The trophy apparatus of claim 3, wherein:

each of the bottom column caps and top column caps is circular in cross-section and cylindrical in shape; and each of the base column grooves and lid column grooves is circular in cross-section and cylindrical in shape.

5. The trophy apparatus of claim 1, further comprising:

a plaque mount provided by the top surface of the base piece; and a plaque piece engageable with the plaque mount.

6. The trophy apparatus of claim 1, wherein:

each of the base column grooves has a height that is substantially equal to a height of the bottom column cap of a corresponding one of the columns; and each of the lid column grooves has a height that is substantially equal to a height of the top column cap of a corresponding one of the columns.

7. The trophy apparatus of claim 1, wherein:

each of the base column grooves has a diameter that is relatively larger than a diameter of the bottom column cap of a corresponding one of the columns, such that each of the base column grooves may receive said corresponding bottom column cap therewithin; and each of the lid column grooves has a diameter that is relatively larger than a diameter of the top column cap of a corresponding one of the columns, such that each of the lid column grooves may receive said corresponding top column cap therewithin.

8. The trophy apparatus of claim 1, wherein the threaded interface of each of the lid column grooves extends from the bottom surface of the lid piece to an opposing top surface of the lid piece, such that the top cap bolt of the corresponding one of the columns is threadably inserted into the threaded interface from the top surface of the lid piece.

9. The trophy apparatus of claim 3, wherein:

each of the base column grooves has a height that is substantially equal to a height of the bottom column cap of a corresponding one of the columns; and each of the lid column grooves has a height that is substantially equal to a height of the top column cap of a corresponding one of the columns.

10. The trophy apparatus of claim 3, wherein:

each of the base column grooves has a diameter that is relatively larger than a diameter of the bottom column cap of a corresponding one of the columns, such that each of the base column grooves may receive said corresponding bottom column cap therewithin; and each of the lid column grooves has a diameter that is relatively larger than a diameter of the top column cap of a corresponding one of the columns, such that each of the lid column grooves may receive said corresponding top column cap therewithin.

11. The trophy apparatus of claim 3, wherein each of the lid column grooves provides a threaded interface positioned and configured for threadably receiving the top cap bolt of a corresponding one of the columns when the top column cap of said corresponding one of the columns is inserted into said lid column groove; and wherein the threaded interface of each of the lid column grooves extends from the bottom surface of the lid piece to an opposing top surface of the lid piece, such that the top cap bolt of the corresponding one of the columns is threadably inserted into the threaded interface from the top surface of the lid piece.

12. The trophy apparatus of claim 5, wherein:

a front surface of the plaque mount provides an at least one U-shaped prong; and a rear surface of the plaque piece provides an at least one inner track positioned and configured for slidably receiving the at least one prong of the plaque mount, thereby engaging the plaque piece with the plaque mount.

13. The trophy apparatus of claim 12, wherein:

the front surface of the plaque mount provides two or more U-shaped prongs positioned in a substantially parallel, spaced apart arrangement; and the rear surface of the plaque piece provides two or more inner tracks positioned in a substantially parallel, spaced apart arrangement.

* * * * *